United States Patent [19]

Liccardello

[11] Patent Number: 4,893,818

[45] Date of Patent: Jan. 16, 1990

[54] GOLF TEE

[76] Inventor: Patrick Liccardello, P.O. Box 23475, Albuquerque, N. Mex. 87192-1475

[21] Appl. No.: 227,984

[22] Filed: Aug. 3, 1988

[51] Int. Cl.[4] ..... A63B 67/14

[52] U.S. Cl. ..... 273/212; 273/32 A

[58] Field of Search ..... 273/33, 203–212, 273/32 A, 32 B

[56] References Cited

U.S. PATENT DOCUMENTS

| | | | |
|---|---|---|---|
| 1,550,483 | 8/1925 | Wulkop | 273/212 |
| 1,558,159 | 10/1925 | Futers et al. | 273/212 |
| 2,693,358 | 11/1954 | Dawson, Jr. | 273/202 |
| 3,559,998 | 2/1971 | Kelly | 273/212 |
| 3,633,919 | 1/1972 | Liccardello | 273/203 |

*Primary Examiner*—T. Brown

*Attorney, Agent, or Firm*—Anthony A. O'Brien

[57] ABSTRACT

A golf tee includes a highly flexible plastic body having an enlarged head with a concave surface for receiving a golf ball, and an axial through-bore. A hard plastic stem, having an outer surface continuous with that of the body, is attached to the body by means of a spear integral with the stem and having a groove thereon for snap engagement within a ridge within a lower portion of the bore. A ball marker is removably installed in the upper end of the bore..

6 Claims, 1 Drawing Sheet

FIG 1
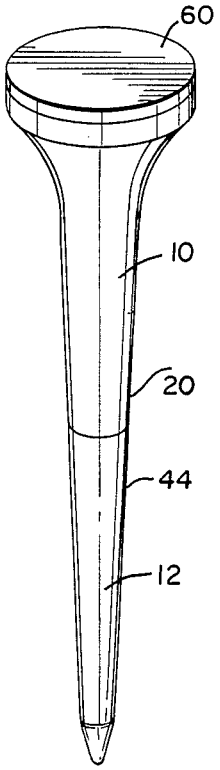
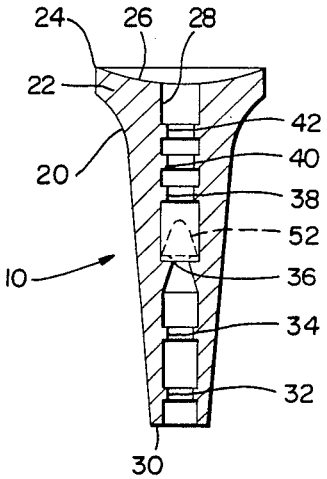
FIG 3
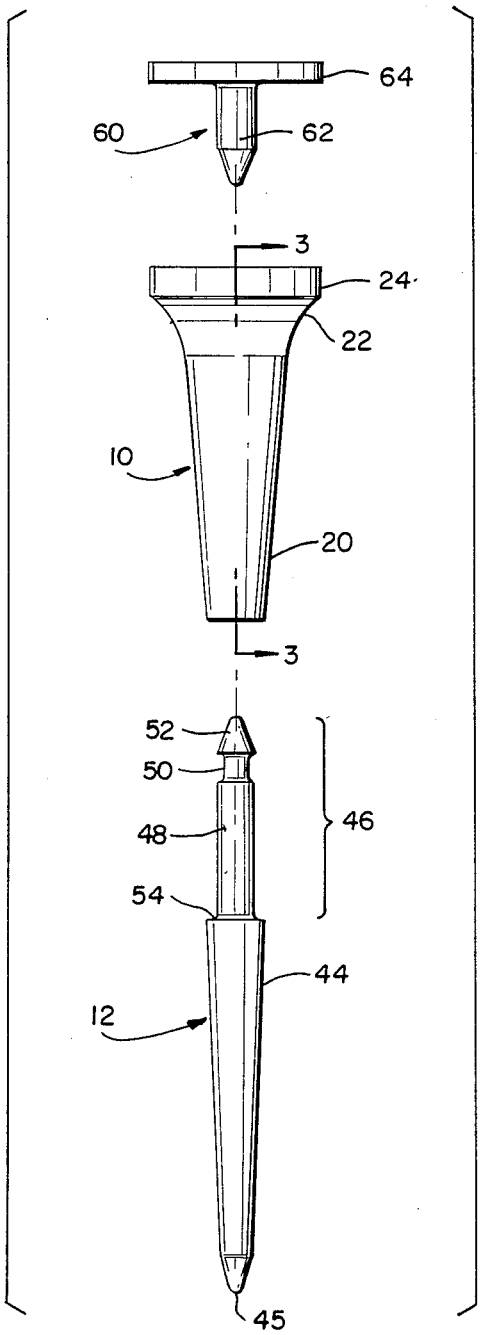
FIG 2

GOLF TEE

BACKGROUND OF THE INVENTION

This invention relates to golf tees, and in particular to an improved tee having upper and lower portions of diverse materials.

The traditional, nondescript, wooden golf tee remains the most common type of tee. Such tees, however, are easily broken, and as a consequence their remains are found scattered about teeing grounds. Wooden tees, having only slight flexibility, can alter the flight of the ball or cut down on driving yardage, particularly if the ball is teed improperly. Prior inventors have improved upon the wooden tee by using other materials, such as metal (to prevent breakage) or plastic, to provide increased flexibility. Multi-part tees have also been proposed, for example, in U.S. Pat. No. 3,633,919, which issued to Frank J. Liccardello in 1972. In that patent, a flexible stem is attached to a metal tip for penetrating the ground; a removable inserter is provided for pushing the tip into the ground, the inserter having a shank that is passed through a bore in the stem to bear directly against the tip so that sufficient force can be applied for inserting the tee into hard ground. While the metal tip of the prior patent was useful to golfers, and despite the fact that the tee was essentially unbreakable, the tee did meet with criticism from some groundskeepers, fearful that lost tees of this type might damage their turf equipment. Also, the untraditional requirement of using an insertion tool for the tee was cumbersome.

SUMMARY OF THE INVENTION

It is therefore an object of this invention to improve upon wooden tees and upon the tee disclosed in U.S. Pat. No. 3,633,919, by providing a multi-part tee made wholly of plastic, so as to be acceptable to course owners.

It is also an object to produce a tee having a striking appearance, but otherwise of traditional shape, and conforming to the rules of the United States Golf Association.

Another object is to provide a tee having a soft upper portion and a hard stem for penetrating the ground, without requiring the use of an insertion tool.

A further object of the invention is to provide a tee with an attractive ball marker removably installed in its head.

A tee satisfying the above requirements includes a highly flexible plastic body having an enlarged head with a concave surface for receiving a golf ball, and an axial through-bore. A hard plastic stem, having an outer surface continuous with that of the body, is attached to the body by means of a spear integral with the stem and having first detent means thereon for snap engagement with second detent means within a lower portion of the bore. A ball marker may be removably installed in the upper end of the bore.

BRIEF DESCRIPTION OF THE DRAWINGS

In the accompanying drawings, FIG. 1 is a perspective view of a golf tee embodying the invention;

FIG. 2 is an exploded side elevation thereof, showing an upper body portion, a stem, and a ball marker prior to assembly; and FIG. 3 is a sectional view taken along the line 3—3 in FIG. 2, showing the upper body portion of the tee alone.

DESCRIPTION OF THE PREFERRED EMBODIMENT

As shown in FIGS. 1–2, the invention is embodied in a golf tee having a body 10 made of a soft, brightly-colored plastic material, and a pointed stem 12 made of a hard plastic material. Referring to FIG. 3, the body 10 has a peripheral surface 20 which diverges upwardly, terminating at a head 22 bounded by a rim 24 and having a concave upper surface 26 whose curvature approximates that of a golf ball. The body has an axial through-bore 28 extending from its upper surface 26 to its bottom 30. The bore has a plurality of annular ridges 32, 34, 36, 38, 40 and 42 spaced along its length, for purposes described below. The ridges are square-edged, except for the ridge 36, whose lower surface diverges downward.

As shown in FIG. 2, the stem 12 has a downwardly converging peripheral surface 44 which is continuous with that of the body 10; that is, the diameter of the upper end of the stem is substantially the same as the outer diamter of the body at its lower end so as to provide a smooth transition between parts. The stem terminates at a point 45 for penentrating the ground. Integrally formed with the stem is an upwardly extending spear 46 comprising a cylindrical shaft 48 having an annular groove 50 therein adjacent a conical tip 52. The shaft 48 has a diameter corresponding to that of the through-bore 28, but larger than the inner diameter of the annular ridges 32, 34 and 36 so as to provide an interference fit of substantial strength to retain the spear within the body once the parts are assembled. An annular shoulder 54 surrounds the shaft 48 at its base. The distance from the shoulder 54 to the groove 50 corresponds to the distance from the bottom 30 of the body to the ridge 36 so that after assembly, the conical tip 52 rests between the ridges 36 and 38, as shown by broken lines in FIG. 3, while the ridges 32 and 34 firmly engage the shaft 48. The angular design of the ridge 36 permits insertion of the conical tip 52 during assembly, while the groove 50 prevents subsequent disassembly.

The tee is preferably sold assembled with a ball marker 60, illustrated in FIG. 2, having a shank 62 sized to fit snugly, but removably, in the upper ridges 40 and 42 of the through-bore 28. The broad, flat head 64 of the marker may be provided with ornamental or identifying indicia, as shown in FIG. 1. The shank has a rounded point at its end, and the marker is generally conventional in appearance. The similarity of the marker diameter to that of the head of the tee makes for an attractive assembly.

In use, the ball marker is removed from the tee body, and the tee is pushed into the ground with the thumb in the ordinary way. The stiffness of the stem enables one to insert the tee even into hard ground. When struck by a club, the resiliency of the body prevents damage either to the tee or the club. As the tee is virtually impossible to break, it is unlikely to be left behind as litter on the teeing ground, and its bright coloring make it easy to locate if it is knocked out of the ground as the ball is driven. Should such a tee nevertheless remain on the course, it will pose no danger to maintenance equipment, because of its all-plastic construction, and it is sure to be picked up when discovered by another player, because of its novel appearance. The tee is therefore advantageous to golfers and course owners alike. As a further advantage, the design of the tee readily admits of production of all three parts by the inexpensive injection molding process.

Inasmuch as the foregoing description and accompanying drawings are illustrative of only one embodiment of the invention, which is subject to variations and modifications, it is intended that the invention shall be measured by the following claims.

I claim:

1. A golf tee comprising an elongated body portion made of a soft plastic material, said body having an axial bore and a concaved ball support surface at one end thereof, a stem made of a hard plastic material, said stem including a point for ground penetration at one end and an integral spear at its other end, said spear including a shaft having a conical tip, said shaft having an annular groove adjacent said tip, and at least one annular ridge disposed within said bore engaging said groove and thereby retaining said spear within said bore of said body portion.

2. The invention of claim 1, wherein said ridge has a downwardly divergent lower surface to facilitate assembly of the tee.

3. The invention of claim 1, comprising a plurality of additional annular ridges spaced along said bore, at least one of said ridges being disposed to engage said shaft and having an interference fit therewith.

4. The invention of claim 1, wherein said body has a first peripheral surface and said stem has a second peripheral surface, said surfaces forming a smooth transition between the body and the stem.

5. The invention of claim 1, wherein said axial bore extends through said body, from its upper surface to its bottom.

6. The invention of claim 5, further comprising a ball marker comprising a flat head and an integral shank sized to fit within said through-bore at said one end of the body.

* * * * *